US008726831B2

(12) United States Patent
Mather et al.

(10) Patent No.: US 8,726,831 B2
(45) Date of Patent: May 20, 2014

(54) APPARATUS AND METHODS FOR PURGING MATERIAL APPLICATION DEVICE

(75) Inventors: Brian Mather, North Olmsted, OH (US); Michael R. Sanner, Amherst, OH (US); Donna Campbell, Huron, OH (US)

(73) Assignee: Nordson Corporation, Westlake, OH (US)

( * ) Notice: Subject to any disclaimer, the term of this patent is extended or adjusted under 35 U.S.C. 154(b) by 620 days.

(21) Appl. No.: 11/980,941

(22) Filed: Oct. 31, 2007

(65) Prior Publication Data

US 2009/0107397 A1 Apr. 30, 2009

(51) Int. Cl.
*B05C 5/00* (2006.01)
*B05B 1/28* (2006.01)

(52) U.S. Cl.
USPC ..... 118/302; 239/104

(58) Field of Classification Search
USPC ..... 239/104; 137/853
See application file for complete search history.

(56) References Cited

U.S. PATENT DOCUMENTS

| | | | | |
|---|---|---|---|---|
| 1,609,465 | A * | 12/1926 | Day | 239/133 |
| 3,210,011 | A * | 10/1965 | Barosko | 239/412 |
| 3,746,254 | A * | 7/1973 | Duncan et al. | 239/697 |
| 5,341,989 | A | 8/1994 | Fulkerson et al. | |
| 6,194,027 | B1 | 2/2001 | Mauchle | |
| 6,223,997 | B1 | 5/2001 | Fulkerson et al. | |
| 6,375,094 | B1 | 4/2002 | Schroeder et al. | |
| 6,622,937 | B2 * | 9/2003 | Schroeder et al. | 239/113 |
| 6,622,948 | B1 | 9/2003 | Haas et al. | |
| 7,617,998 | B2 | 11/2009 | Mauchle et al. | |
| 2002/0130200 | A1 * | 9/2002 | Hurray et al. | 239/407 |

FOREIGN PATENT DOCUMENTS

| | | |
|---|---|---|
| EP | 0899016 | 3/1999 |
| EP | 0913204 | 5/1999 |
| JP | H02217515 | 8/1990 |
| JP | 11-128781 | 5/1999 |
| WO | 03031075 | 4/2003 |

OTHER PUBLICATIONS

European Search Report dated Dec. 9, 2011, for European Patent Application No. 08253450.
Office Action dated Aug. 1, 2013, for corresponding Japanese Patent Application Serial No. 2008-280658.
Office Action dated Nov. 11, 2013, for corresponding Chinese Patent Application Serial No. 200810171037.5.

* cited by examiner

*Primary Examiner* — Dah-Wei D Yuan
*Assistant Examiner* — Charles Capozzi
(74) *Attorney, Agent, or Firm* — Calfee, Halter & Griswold LLP

(57) ABSTRACT

Purge method and apparatus for a manual spray gun or coating material application device, in which purge air is introduced into the device through a handgrip portion that is manually held during a coating operation. Purge air first enters the coating material flow path after the purge air enters the handgrip portion.

20 Claims, 8 Drawing Sheets

APPARATUS AND METHODS FOR PURGING MATERIAL APPLICATION DEVICE

TECHNICAL FIELD OF THE DISCLOSURE

The disclosure relates to the art of applying material onto surfaces, such as for example, spraying or coating a surface with a coating material. More particularly, the disclosure and inventions relate to purging arrangements and methods for a material application device such as a spray gun.

BACKGROUND

Powder coating material such as powder paint is commonly applied to an object by spraying the powder coating material. Typically, a spray gun or material application device is used, and spray guns may be manually held and operated or automatic spray guns may be used that are controlled electronically. Spray technologies include for example electrostatic, non-electrostatic and tribo-electric. The powder flow path through a spray gun must be purged whenever the powder coating material, such as its color or other characteristic, is changed, in order to prevent unwanted contamination.

SUMMARY OF THE DISCLOSURE

The present disclosure presents a number of inventive aspects for both apparatus and methods relating to purging a coating material flow path through a material application device, such as, for example, a manually operated spray gun. In accordance with one inventive aspect, purge air may be introduced at a purge air inlet on a handgrip, such as for example, a handle of the material application device. In a specific embodiment, purge air may be introduced into a base of the handle. In another embodiment, the purge air inlet is separate from a coating material inlet that may also be on or associated with the handle. In another embodiment, purge air may be introduced into the handle before the purge air enters the coating material flow path. In still a further embodiment, a purge air flow path may be provided from the purge air inlet on the handle to a purge air entry into a coating material flow path that is at least partially disposed within or associated with the handle.

Additional and optional inventive aspects and embodiments include but are not limited to: a coating material application system comprising a purge arrangement through the handle of a material application device; a quick release mechanism for a supply hose; a one way flow device, such as a check valve for example, in the purge air flow path; and alternative embodiments for introducing purge air into a coating material flow path using a purge air inlet on the handle.

The disclosure also contemplates methods embodied in the use of such apparatus. The disclosure further presents inventive methods including in one embodiment a method for purging a coating material application device wherein purge air is introduced into the device through a handle of the device before entering the material flow path.

Further inventive aspects, advantages and benefits will become apparent to those skilled in the art after considering the following description in conjunction with the accompanying drawings.

DETAILED DESCRIPTION OF EXEMPLARY EMBODIMENTS

Figure 1:
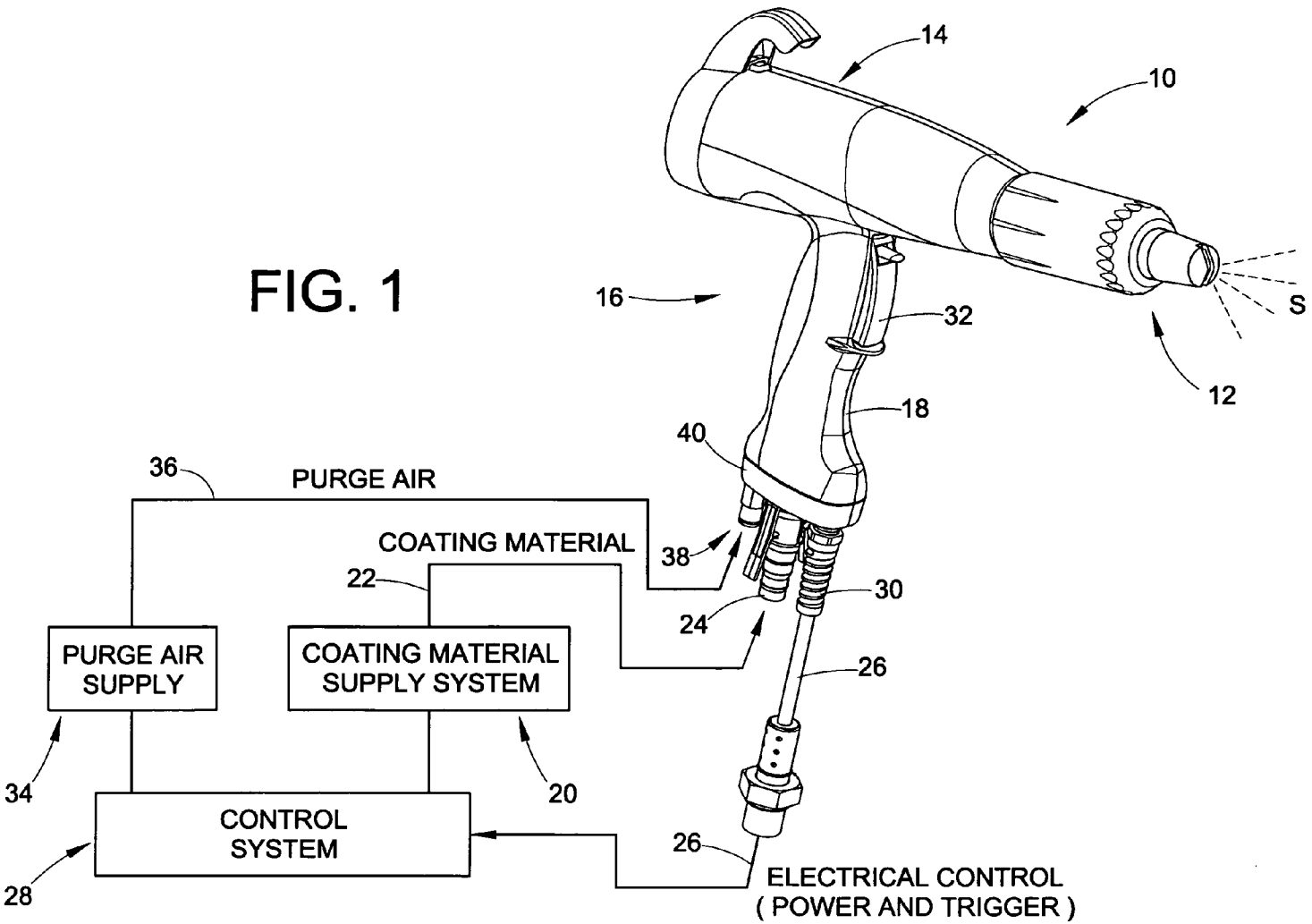
FIG. 1 is an isometric illustration of one embodiment of a material application device, in a material application system, that incorporates one or more inventive aspects of the present disclosure.

The inventions described herein are explained and illustrated in the context of a powder coating material application device, such as, for example, an electrostatic powder spray gun. However, the exemplary embodiments are not intended to be a limitation on the application or use of the various inventive aspects presented in this disclosure. For example, the inventions may be used with non-electrostatic devices and with tribo-charging guns that do not utilize an electrode, or combinations thereof. The inventions also are not limited to any particular type or use of coating material. Additionally, the terms 'spray' and 'spray pattern' are intended to be understood in their broadest meaning to include not only those processes commonly referred to as 'spray' or 'spraying' but additionally any application technique involving the directing of a generally dry particulate coating material across a space towards a target. The spray pattern may be but need not be atomized. When used, atomization may be based on pressure, air, or both or other atomization techniques and combinations thereof. Still further, the terms 'spray' and 'spray patterns' are not to be limited to any particular time duration that the material is directed towards the target. In other words, very short bursts of material or narrow jets of material are still to be construed as falling within the understanding herein of the word 'spray' and 'spray pattern'.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the scope of the inventions instead being set forth in the appended claims or the claims of related or continuing applications. Descriptions of exemplary methods or processes are not limited to inclusion of all steps as being required in all cases, nor is the order that the steps are presented to be construed as required or necessary unless expressly so stated.

With reference to FIG. 1, a manually operated material application device 10 may include a nozzle portion 12, a barrel portion 14 and a handgrip portion 16. In the examples herein, the device 10 may be, for example, any suitable material application device or spray gun configuration. The terms spray gun and material application device are used herein interchangeably, however, it is to be understood that a material application device may be realized in many forms other than just a spray gun and is not limited to that terminology. Typically, the nozzle portion 12, barrel portion 14 and handgrip portion 16 are each multi-piece assemblies, and also separable from each other. However, the present disclosure and the inventions herein are not limited to any particular design, shape or configuration of the application device 10 or its constituent parts, including the design, shape or configuration of the handgrip portion 16, and may include machined parts, molded parts, combinations thereof, integrated portions and so on. Rather, the present disclosure relates to the handgrip portion 16 and more specifically to purging arrangements and methods for a coating material flow path or at least a portion thereof (not visible in FIG. 1) that extends from the handgrip portion 16 along the barrel portion 14 and to the nozzle portion 12. The various inventions and inventive aspects of the disclosure may be realized in far too numerous ways and configurations of the handgrip portion 16, as well as the barrel portion 14 and nozzle portion 12 to identify and disclose herein.

The handgrip portion 16 may be realized in the form of a handle 18 that is manually held or gripped during operation of the spray gun 10. For electrostatic devices 10, the handle 18 may include a portion that contacts the operator's hand and is grounded. For purposes of this description, the term handgrip is generally used to refer to any structure or assembly or member that is manually held or gripped by an operator during operation of the application device 10 to support and control the device 10, with a handle, grip or other structure being embodiments of such a handgrip.

As illustrated in FIG. 1, a coating material supply 20 may be used as a source of coating material to the spray gun 10. A feed or supply hose 22 is commonly used to connect the spray gun 10 with the supply 20. A hose connector 24 may be provided to securely attach the supply hose 22 to the spray gun. In the case of an electrostatic spray gun as shown in FIG. 1, an electrical control cable or connection 26 may be provided between a control system 28 and an electrical input 30 of the spray gun. The control system 28 may also receive one or more signals from the spray gun 10, such as for example a trigger actuation signal that indicates that the operator has activated a trigger 32 to initiate a coating operation or has initiated a purge operation. The control system 28 may be any suitable arrangement as is well known in the art for controlling input power and operation of the spray gun electrical requirements, as well as controlling operation of the coating material supply 20, purge supply (to be described) and other system related features such as a spray booth, parts conveyor and so on. The control system 28 and the supply 20 form no part of the present inventions except as used in combination with a purging arrangement and method as set forth herein. The coating material supply 20 typically includes a pump that is under the control of the control system 28 so that the control system 28 starts the pump in response to the operator actuating the trigger 32. This causes coating material to flow through the handgrip portion 18, the barrel portion 14 and out through the nozzle portion 12 to form a desired spray pattern S, typically in the form of a cloud like pattern for powder coating material, for example.

A purge supply 34 under the control of the control system 28 may be used to provide pressurized purge air or other gas through a purge hose 36 to the spray gun 10. The purge hose 36 is connectable to a suitable hose connector input 38 disposed on the handgrip 16. In accordance with one inventive aspect of the present disclosure, purge air is introduced into the spray gun 10 through an inlet disposed in or on the handgrip 16, and in the exemplary embodiment through a base 40 of the handle 18. The purge air inlet to the handgrip 16 is thus separate from the coating material input at the hose connector 24, so that purge air initially enters a coating material flow path (not shown in FIG. 1) by first passing through a purge air flow path within the handgrip 16, as will be more fully described herein below.

Figure 2:
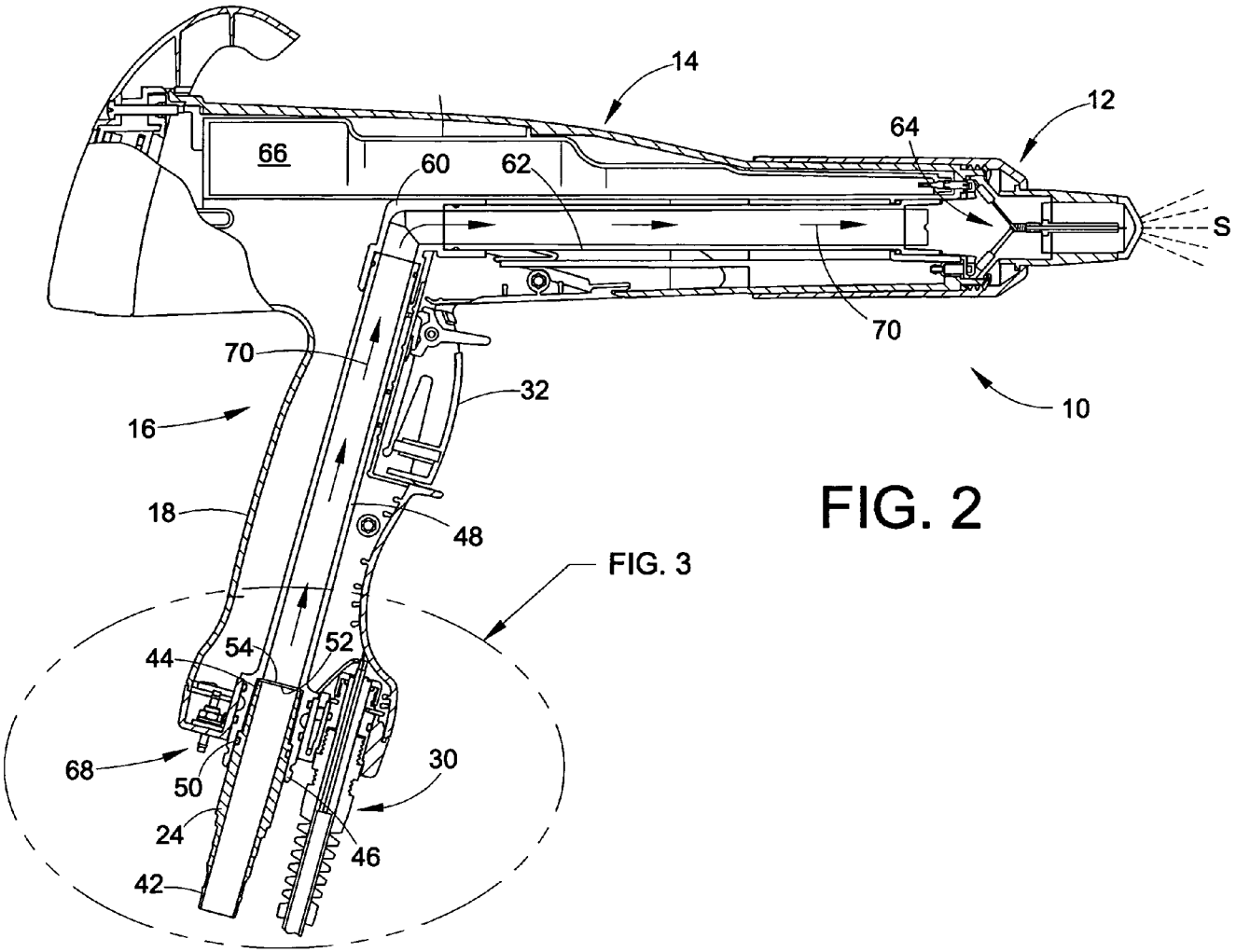
FIG. 2 is an elevation of the embodiment of the material application device of FIG. 1, shown in longitudinal cross-section.
Figure 3:
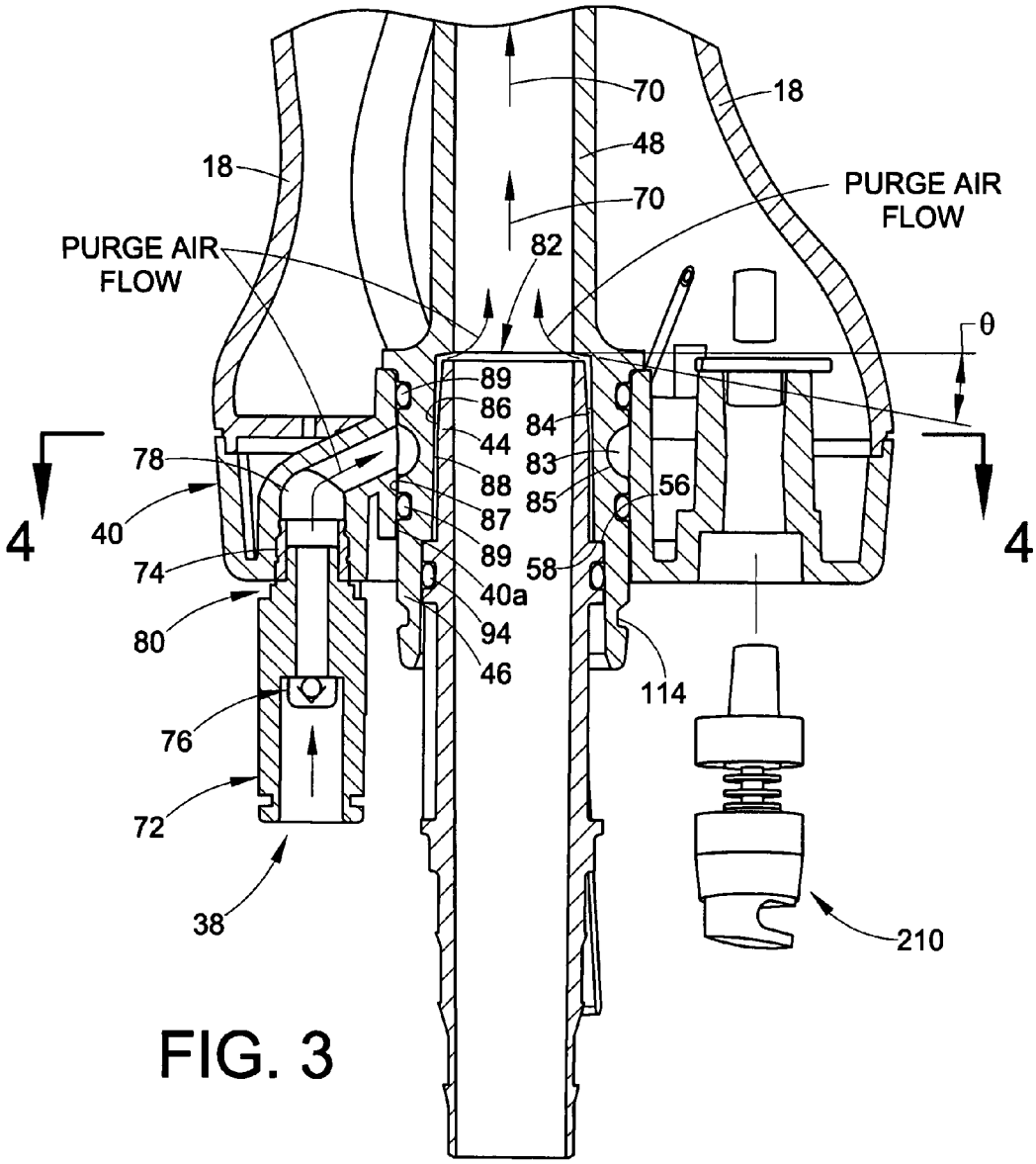
FIG. 3 is an enlarged view of the region circled in FIG. 2.

FIGS. 2 and 3 illustrate the application device 10 in longitudinal cross-section. As shown, the handle 18 may be ergonomically contoured to ease strain on the operator's hand during prolonged operation or shifts. The coating material hose connector 24 has a first end 42 adapted to receive one end of the supply hose 22 (not shown) and an opposite end 44 that telescopically slides into a first end 46 of an inlet tube 48. A seal 50, such as an o-ring for example, may be provided in a seal groove on the hose adapter 24 to prevent blowback of coating material at the interface between the hose connector 24 and the inlet tube 48. The hose connector 24 inner end 52 extends forward into the barrel of the inlet tube end 46, however, is dimensioned to present a gap between the inner end 52 and an interior shoulder 54 of the inlet tube end 46 for reasons that will be explained further herein below. A second interior shoulder 56 (FIG. 3) may be provided in the inlet tube end 46 that cooperates with and engages an exterior shoulder 58 (FIG. 3) formed on the hose connector 24 so as to limit and fix the amount of axial insertion of the hose connector 24 into the inlet tube end 46. Other techniques may be used as needed to provide a gap between the inner end 52 of the hose connector 24 and the interior shoulder 54 of the inlet tube 48.

The inlet tube 48 extends up through the handle 18 and mates, such as for example with a telescopic connection, with one end of an elbow adapter 60. The elbow adapter 60 has another end that mates with, such as for example with a telescopic connection, a first end of an outlet tube 62. The outlet tube 62 extends along the barrel portion 14 to the nozzle portion 12 so that coating material exits through the distal end of the outlet tube, and into and through the nozzle portion 12 to form the spray pattern S. The details of the nozzle portion 12 are not needed for understanding and practicing the inventions of this disclosure. In alternative designs, for example, the outlet tube may itself form or provide an outlet orifice through which coating material exits the nozzle. In the exemplary embodiments herein, the nozzle portion 12 includes an electrode assembly 64 that is charged by an internal power supply 66 in the rearward portion of the barrel 14. Many different types of electrode assemblies may be used, including electrode tips that are positioned outside the nozzle portion 12, as well as many different types of power supply designs, configurations and locations, including external power supplies. An electrode air wash inlet 68 may be provided that is connectable to a source of pressurized air, with an air passageway (not shown) that extends up through the handle 18, along the barrel portion 14 and into the nozzle portion 12 so as to provide a flow of air across the nozzle tip to help prevent the accumulation of coating material on the nozzle tip.

The inlet tube 48, the elbow 60 and the outlet tube 62 thus combine to form or define a coating material flow path—in the exemplary embodiment being formed by the interior volume of the inlet tube 48, the elbow 60 and outlet tube 62 (and as represented by the arrows associated with the numeral 70)—that extends from the handle 18, along the barrel portion 14 to the nozzle portion 12. For purposes of this disclosure, the coating material flow path 70 is considered to be that portion of the overall material flow path that can be purged, and thus, in the exemplary embodiments hereof, may further be considered to include the nozzle portion 12. Of significance, the coating material flow path 70 includes at least a portion that is disposed in or associated with the handgrip portion 16. In the exemplary embodiments herein, a portion of the coating material flow path is disposed within the interior volume of the handgrip portion 16, however, the inventions contemplate that the material flow path may include portions that are part of an exterior wall or disposed on an exterior wall of the handgrip portion 16, to name some alternative examples. Rather than separate inlet and outlet tubes and elbows, the material flow path may also alternatively be provided by passageways that are integrally formed in the spray gun body.

FIG. 3 illustrates an enlarged view of the base portion of the application device 10 of FIG. 2. A purge hose connector 72 may be provided that inserts into a receptacle 74 of the handgrip portion 16, in particular in this case disposed in the base 40 of the handle 18. The purge hose connector is adapted to releasably retain the purge hose 36 (FIG. 1). An optional check valve 76 may be provided, anywhere along the purge air flow path, but in this example may be conveniently disposed within the purge hose connector 72. Any suitable check valve may be used. The optional check valve 76 may be used to prevent blowback of coating material from the coating material flow path into the purge air supply 34 or the purge air supply hose 36.

An internal purge air passageway 78 receives purge air from the purge air connector 72 (during a purge operation as distinguished from a coating operation). The passageway 78 thus defines in this embodiment a purge air inlet 80 to the handle 18 although alternatively one may consider the outer end of the purge hose adapter 72 to be a purge air inlet. The passageway 78 also defines in part a purge air flow path that provides purge air flow from the purge air inlet 80 into the coating material flow path 70. This purge air inlet 80 is separate from the coating material inlet 82 to the handle 18. Whether the coating material inlet is deemed to be the gun end of the supply hose 22, or the inner end 44 of the hose adapter 24, or the coating material entrance to the inlet tube 48 is not a critical distinction, although for the exemplary embodiment, we deem the shoulder 54 to define or circumscribe the coating material inlet 82 since in this embodiment that is the region that purging begins for the coating material flow path 70. In any case, a salient feature is that purge air inlet that is disposed on or otherwise associated with the handgrip 16 is separate from the coating material inlet 82. By separate is meant that purge air enters the handgrip 16 along a purge air flow path that is at least initially isolated from the coating material flow path (keeping in mind that the purge air flow path 80 is in fluid communication with the coating material flow path 82 so that the purge air can purge the coating material during a purge operation. Stated alternatively, purge air enters the handgrip portion 16 before the purge air enters the coating material flow path 70. In contrast, for example, known systems purge by applying purge air into the supply hose 22 back near the coating material supply 20 so that the purge air enters the coating material flow path before passing into a handle of the spray gun.

Figure 5:
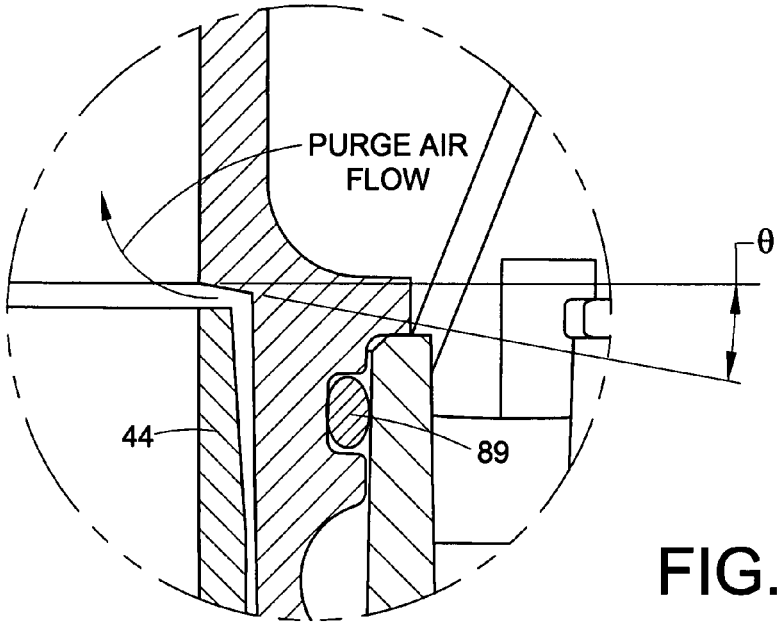
FIG. 5 is an enlarged illustration of the interface between a purge air flow path and a coating material flow path for the exemplary embodiment of FIGS. 1-4.

With continued reference to FIG. 3, as well as the enlarged view of FIG. 5, the interior end of the purge air passageway 78 opens to a cavity 83 formed by a circumferential recess region or notch 85 and an inner surface 40*a* of the base member 40. The recess 85 may be provided, for example, in an outer surface 87 of the inlet tube end 46. Two seals 89, such as o-ring seals, for example, may be used to seal the cavity 83 against loss of air into the handle 18 interior or loss of air out the back end of the handle 18.

An annulus or annular volume 84 is formed between an outer surface 86 of the inner end 44 hose connector 24, and an inner surface 88 of the first end 46 of the inlet tube 48. This annulus 84 extends up to and slightly beyond the inner end 52 of the hose connector 24. A seal 94, such as an o-ring seal for example, may be used to block the flow of purge air out the back end of the spray gun. Purge air is thus forced to travel up the annulus 84 and into the coating material flow path 70 by entering the inlet tube 48 at the region or coating material inlet 82.

Figure 4:
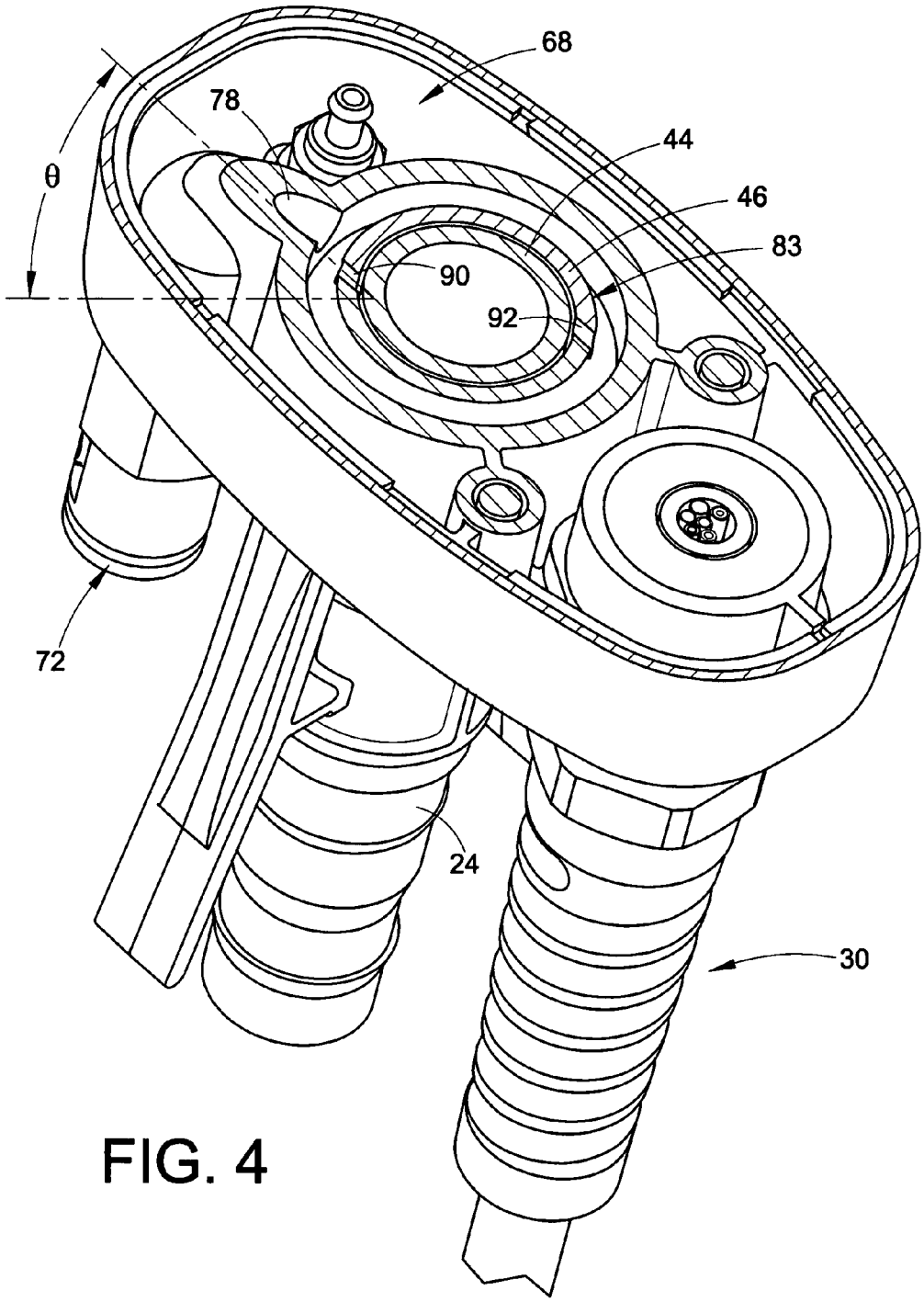
FIG. 4 is a perspective view of the material application device of FIG. 3 taken in lateral cross-section along line 3-3.

Purge air that enters the purge air passageway 78 flows into the recess 85. As best illustrated in FIG. 4 (note that FIG. 4 also partially shows a hose retainer that will be described herein below) at least one, and in this embodiment two, through holes 90 and 92 are provided through the wall of the inner end 46 of the inlet tube 48, in the region of the recess 85. Purge air thus passes from the cavity 83 volume into the annular volume 84 via the through holes 90, 92. The holes 90, 92 may be located at any convenient location that permits purge air to flow from the cavity 83 into the annular volume 84. As also illustrated in FIG. 4, the through holes 90, 92 may optionally be formed at an orientation or angle $\alpha$ other than radially into the annular volume 84, in other words, somewhat tangential or offset from radial, so as to impart a swirling or rotating type flow pattern around the annular volume 84.

Referring again to FIGS. 2, 3 and 5, the interior shoulder 54 may optionally be formed at an angle $\theta$ from radial, rather than being a radial shoulder. The angle $\theta$ of the shoulder is not critical, and may be as small as a few degrees from radial, for example. We have found that in some cases, if the shoulder 54 is radial, the purge air may flow backward down the supply hose 22 rather than forward through the spray gun. This may be prevented by including the small angle or chamfer on the shoulder. The angle $\theta$, however, must not be made too large, as in some cases this can cause a pumping effect by which coating material may be sucked up into the gun from the supply hose during a purge operation. A suitable range for the angle $\theta$ may be from about two degrees (from radial) to about thirty degrees (from radial), with a more preferred value of about ten degrees (from radial). However, those skilled in the art will appreciate that the angle θ will be determined based on the overall design of the spray gun and the purging requirements.

Figure 6:
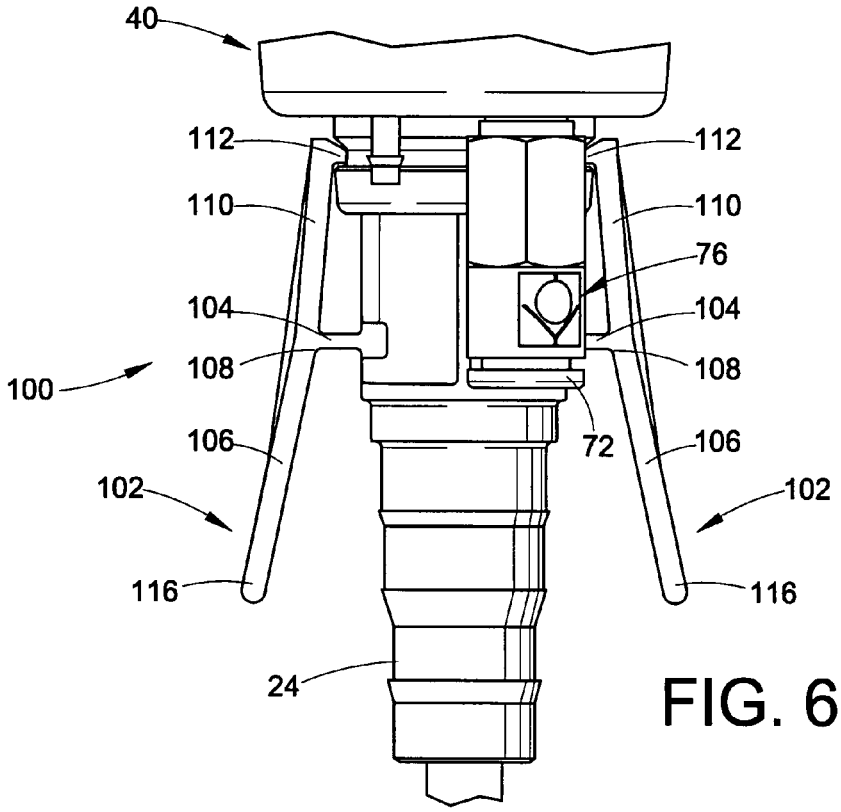
FIG. 6 is a side view of a quick disconnect assembly for a supply hose to a material application device, such as may be used with the embodiment of FIG. 1.

With reference to FIG. 6, we show a quick connect and disconnect arrangement 100, such as may be used on any material application gun having a hose connection. The hose connector 24 may be provided with the arrangement 100 as an optional add-on feature or integrated into the hose connector 24. A set of flexible arms 102 are provided. There may be as few as one such arm, or two or more depending on the particular application. Each arm 102 includes a mounting leg 104 that attaches to or is otherwise secured with the hose connector 24. The mounting leg 104 is attached to a flexing arm 106 at a pivot point 108 generally but not necessarily in the middle portion of the flexing arm 106. The flexing arm 106 has a distal end 110 with an inwardly extending hook or catch 112. Each flexing arm is suitably biased so that in its free state, the hooks 112 are received in a circumferential groove 114 (or alternatively series of short grooves) provided in an outer surface of the lower end 46 of the inlet tube 48 (see also FIG. 3). The various parts are dimensioned so that when the hose connector 24 (with or without the supply hose 22 already installed) is fully inserted into the inlet tube end 46 (such that the shoulders 56 and 58 abut, as shown in FIG. 3), the hooks 112 snap into the groove 114 and function to prevent the hose connector 24 from being pulled out by inadvertent application of force on the supply hose 22 or the hose connector 24. In order to quickly release the hose connector 24 (with or without an attached hose), an operator simply applies inward force against the distal ends 116 of the flexible arms 102, causing a pivoting motion to the arms 102 so as to release the hooks from 112 from the groove 114, thus allowing the hose adapter 24 to be easily withdrawn from the inlet tube 48.

Figure 7:
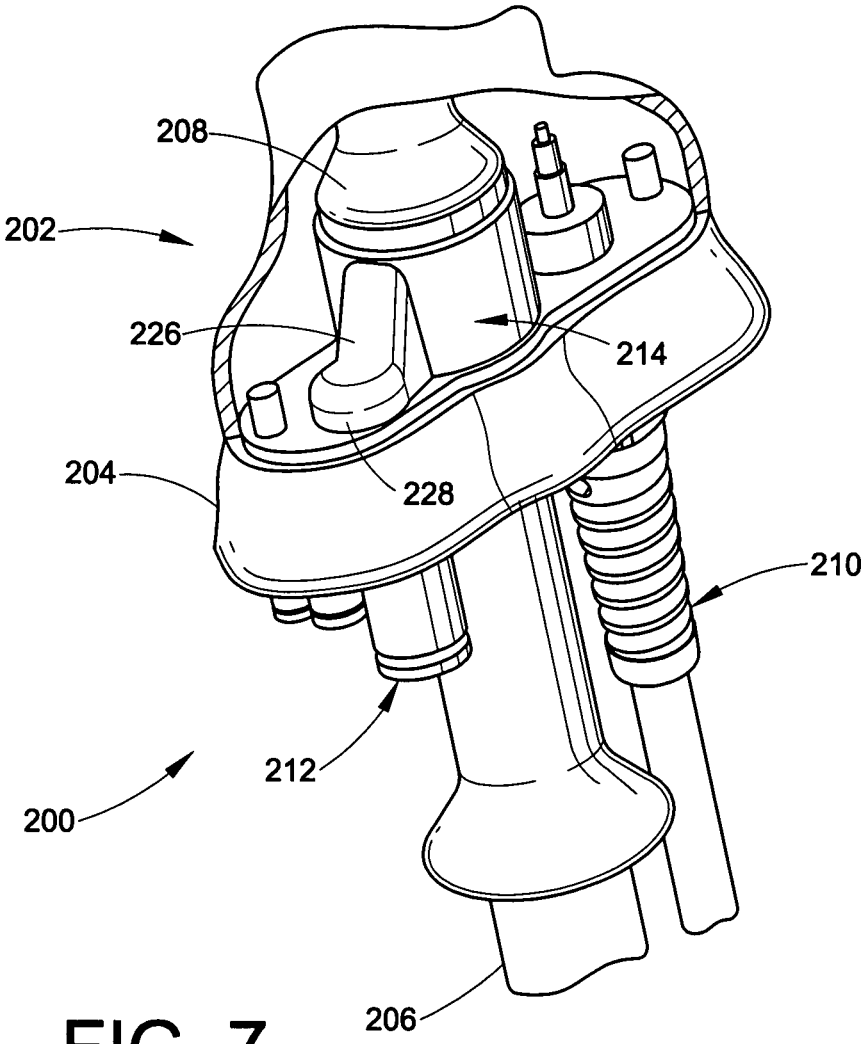
FIG. 7 is a perspective illustration of another embodiment of a purge arrangement for a manual spray gun, shown in partial cross-section.
Figure 8A:
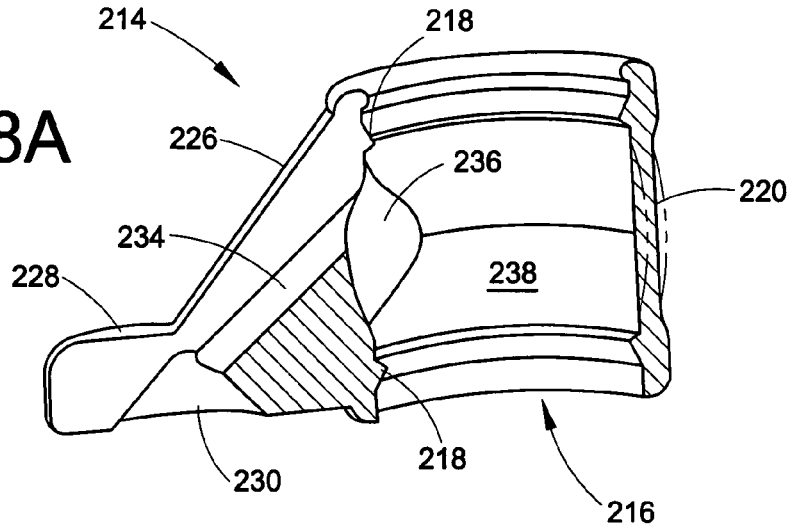
FIGS. 8A and 8B illustrate a purge air boot, in partial longitudinal cross-section in FIG. 8A and isometric in FIG. 8B.
Figure 8B:
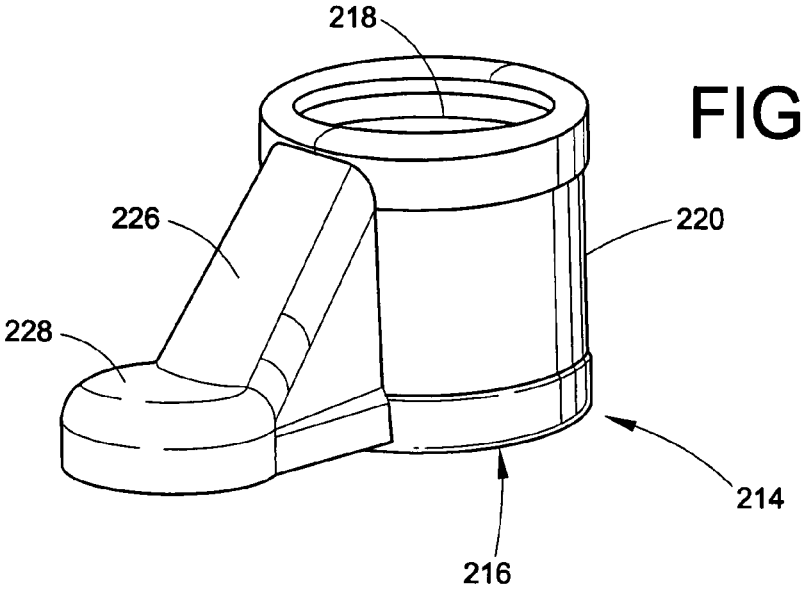
Figure 9:
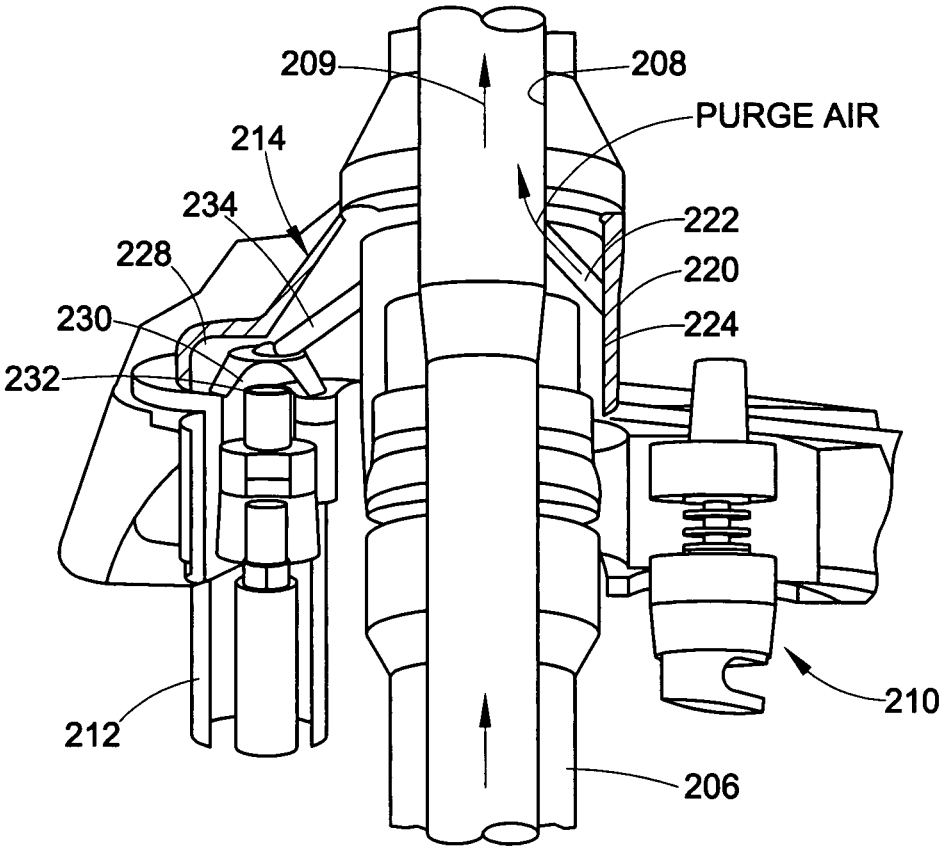
FIG. 9 is another illustration of the embodiment of FIG. 7 in longitudinal cross-section.

With reference next to FIGS. 7-9, an alternative embodiment of a purge arrangement for a manual coating material application device 200 such as a manually operated spray gun for example is illustrated. Note that FIGS. 7 and 9 illustrate much of the spray gun 200 handgrip portion in phantom for ease of illustration and clarity, and also only illustrate the area of interest in the base of the handle, omitting the rest of the gun structure as it may be but need not be similar to the structure shown in FIGS. 1-5, or any other suitable gun arrangement and configuration.

In this embodiment, the application device 200 may include a handgrip portion 202 having a base 204, with the handgrip portion 202 being manually gripped by an operator during operation of the spray gun 200. A coating material supply hose 206 may be connected to the spray gun 200 by any convenient arrangement, so as to permit flow of coating material into an inlet tube 208 during a coating operation (see FIG. 9). The inlet tube 208 thus defines a portion of the coating material flow path 209 (which extends up through the handgrip portion, along the barrel portion and to the nozzle portion as in the above described embodiment), with the portion being disposed in the handgrip portion. In this example, the coating material enters the spray gun 200 through the base 204 of the handgrip 202. An electrical input connection 210 may be included for electrostatic spray guns. A purge air input connector 212 is provided that is connectable to a purge air hose (not shown), such as the hose 36 in the FIG. 1 embodiment. As in the first embodiment herein, the purge air enters the handgrip 202, in this example through the base 204, along a path that is separate from the entry path of the coating material.

An elastomeric boot 214 provides an arrangement by which the purge air can be introduced into the coating material flow path 209 to purge the coating material flow path during a purge operation. As best shown in FIGS. 8A and 8B, the boot 214 may include a generally cylindrical body portion 216 that is closely received around a purge inlet portion of the inlet tube 208. The cylindrical portion 216 may include one or more lip seals 218 that tightly engage an outer surface of the inlet tube in order to contain pressurized purge air and allow a central portion 220 of the cylindrical wall to expand in a bladder like manner when pressurized purge air is applied to the boot. This expansion of the wall 220 is represented in phantom in FIG. 8A in a somewhat exaggerated manner for clarity.

As best illustrated in FIG. 9, the inlet tube 208 includes one or more through holes 222 that extend from an outer surface 224 of the inlet tube 208 and open into the coating material flow path 209. When installed on the inlet tube 208, an inner surface of the boot central wall portion 220 forms a face seal against the outer surface 224 of the inlet tube in the area of the through hole 222 so as to seal the hole or holes when purge air is not present. When purge air is presented to the boot, the air pressure causes the wall portion 220 to expand outward, thus opening the face seal by separating the wall 220 inner surface from the outer surface 224 of the inlet tube 208, thereby allowing purge air to flow through the holes 222 and into the coating material flow path 209.

Referring again to FIGS. 8A and 8B, the boot 214 may include an extension leg 226 with an inlet cap 228 on the end thereof. The inlet cap 228 may be provided with a cavity 230 on a lower surface thereof that overlays a purge air inlet tube 232 (see FIG. 9 as well). A passageway 234 extends from the cavity 230 through the extension leg 226 to a somewhat enlarged volume 236 within the central cylindrical portion of the boot body 216, between the lip seals 218. In this manner, purge air from the purge air inlet 232 flows into the annular region that is between the inner surface 238 of the boot cylindrical wall and the outer surface 224 of the inlet tube 208. FIG. 8A illustrates in phantom and in a somewhat exaggerated manner the balloon effect of the wall portion 220 when pressurized purge air is introduced into the boot 214.

The inventions have been described with reference to the exemplary embodiments. Modifications and alterations will readily occur to others upon a reading and understanding of this specification and drawings. It is intended to include all such modifications and alterations insofar as they come within the scope of the appended claims or the equivalents thereof.

The invention claimed is:

1. A powder coating material spray gun, comprising:

a barrel, a nozzle mounted to the front end of the barrel, a handle that is manually gripped by an operator during a coating operation, the top of said handle being connected to the rear end of said barrel, a base member connected to the bottom of said handle, a coating material inlet tube that extends through said handle and is connected to said base member of said handle, a hose connector, said coating material inlet tube being connected to a top end of said hose connector, a bottom end of said hose connector being connectable to a first end of a coating material supply hose wherein an annular space is provided between said hose connector and said coating material inlet tube, said first end of said supply hose being below said handle, a purge air inlet provided in said base member, said purge air inlet being connected by one or more passages in said coating material inlet tube to said annular space provided between said hose connector and said coating material inlet tube, a coating material flow path extending from said base member of said handle up through said handle and along said barrel to said nozzle, said coating material inlet tube providing a portion of said coating material flow path, wherein purge air passes through said purge air inlet and then through said one or more passages in said coating material inlet tube to said annular space between said hose connector and said coating material inlet tube to purge said coating material flow path.

2. The apparatus of claim 1 comprising an electrode air wash inlet that is separate from said coating material inlet tube and said purge air inlet.

3. The apparatus of claim 1 wherein said handle comprises a purge air flow path through which purge air flows from said purge air inlet into said coating material flow path.

4. The apparatus of claim 3 wherein said purge air flow path comprises said annular space about said coating material inlet tube at said connection with said hose connector, and a passageway between said purge air inlet and said annular space.

5. The apparatus of claim 4 wherein said supply hose receives coating material from a coating material supply.

6. The apparatus of claim 4 wherein said hose connector is connected with said coating material inlet tube by a quick release connector.

7. The apparatus of claim 6 wherein said hose connector telescopes into said coating material inlet tube with said annular space defined between respective adjacent walls thereof.

8. The apparatus of claim 1 wherein at least a portion of the purge air entering said coating material inlet tube from said annular space flows along a surface that includes a shoulder that is angled other than perpendicular a longitudinal axis of said coating material inlet tube.

9. The apparatus of claim 2 comprising an electrode that charges coating material from said nozzle, with electrode wash air flowing from said air wash inlet through an air wash passageway to a tip of said electrode, said air wash passageway being separate from said coating material flow path.

10. The apparatus of claim 4 wherein purge air flows into said annular space at an angle that produces a swirling flow of the purge air through said annular space.

11. The apparatus of claim 1 wherein purge air enters said coating material flow path during a purging operation at a location that purges coating material from said coating material inlet tube, through a barrel of said gun and through said nozzle.

12. The apparatus of claim 11 comprising a flexible boot disposed on said handle, said boot providing a pressure responsive seal between a purge air flow path and said coating material flow path.

13. The apparatus of claim 12 wherein said boot comprises a purge air passage and a flexible wall that moves in response to purge air pressure to allow purge air to flow into said coating material flow path.

14. The apparatus of claim 13 wherein said boot is connectable to a source of pressurized air.

15. The powder coating material spray gun of claim 1, wherein said coating material flow path further comprises an outlet tube that extends through said barrel.

16. The powder coating material spray gun of claim 15, further comprising an elbow that connects said inlet tube to said outlet tube.

17. The powder coating material spray gun of claim 1, wherein an annular cavity is formed on the exterior of said inlet tube, and wherein said one or more air passages are formed in said inlet tube between said outer cavity and the interior of said inlet tube, and wherein purge air passes from said purge air inlet into said annular cavity and through said air passages into said annular space.

18. The powder coating material spray gun of claim 17, wherein said base member has an annular opening that receives the bottom end of the inlet tube and is sealed to the bottom end of the inlet tube.

19. The powder coating material spray gun of claim 18, wherein seals are provided on the inlet tube above and below the annular cavity, said seals being in contact with the annular opening in the base member.

20. The powder coating material spray gun of claim 19, wherein the purge air inlet has an outlet that aligns with the annular cavity of the inlet tube.

* * * * *